US007441525B2

(12) United States Patent
Jessberger et al.

(10) Patent No.: US 7,441,525 B2
(45) Date of Patent: Oct. 28, 2008

(54) CYLINDER HEAD COVER FOR A CYLINDER HEAD OF AN INTERNAL COMBUSTION ENGINE

(75) Inventors: Thomas Jessberger, Asperg (DE); Ines Klamert, Ludwigsburg (DE); Ingo Koch, Steinheim (DE); Alexander Korn, Gueglingen (DE); Thomas Schleiden, Stuttgart (DE); Andreas Weber, Ludwigsburg (DE); Michael Daiber, Sindelfingen (DE); Klaus Gessner, Muehlacker (DE); Timo Walz, Gondelsheim (DE); Ralf Salameh, Gondelsheim (DE); Wilhelm Schneider, Rednitzhembach (DE); Daniel Westphal, Nuernberg (DE)

(73) Assignees: Mann & Hummel GmbH, Ludwigsburg (DE); Federal Mogul Sealing Systems Bretten GmbH, Bretten (DE)

( * ) Notice: Subject to any disclaimer, the term of this patent is extended or adjusted under 35 U.S.C. 154(b) by 0 days.

(21) Appl. No.: 11/708,048

(22) Filed: Feb. 20, 2007

(65) Prior Publication Data

US 2007/0234995 A1 Oct. 11, 2007

Related U.S. Application Data

(63) Continuation of application No. PCT/EP2005/054092, filed on Aug. 19, 2005.

(30) Foreign Application Priority Data

Aug. 20, 2004 (DE) ..... 10 2004 040 656

(51) Int. Cl.
*F01P 1/04* (2006.01)

(52) U.S. Cl. ..... 123/90.37; 123/90.38; 123/193.5; 123/195 C; 277/591; 277/916

(58) Field of Classification Search ..... 123/90.37, 123/193.3, 195 C, 90.33, 90.38, 193.2, 193.5, 123/198 E, 198 F; 277/628, 167.5, 591, 651, 277/916

See application file for complete search history.

(56) References Cited

U.S. PATENT DOCUMENTS 5,687,975 A * 11/1997 Inciong ..... 277/591
6,561,522 B1 * 5/2003 Radelet et al. ..... 277/628

FOREIGN PATENT DOCUMENTS

JP 2002364754 A * 12/2002

* cited by examiner

*Primary Examiner*—Ching Chang
(74) *Attorney, Agent, or Firm*—Crowell & Moring LLP

(57) ABSTRACT

A cover for a cylinder head of an internal combustion engine having a connecting element for attachment the cylinder head and a sealing element arranged between the cylinder head cover and the cylinder head. The connecting element is associated with a connecting area, and the sealing element is associated with a sealing area. The connecting area and the sealing area are constructed independently of each other and are spatially separated from each other, and the force vectors of the connecting force transmitted by the connecting element and the sealing force transmitted by the sealing element form an angle with each other.

11 Claims, 3 Drawing Sheets

CYLINDER HEAD COVER FOR A CYLINDER HEAD OF AN INTERNAL COMBUSTION ENGINE

CROSS REFERENCE TO RELATED APPLICATIONS

This application is a continuation of international patent application no. PCT/CP2005/054092, filed Aug. 19, 2005, designating the United States of America and published in German on Mar. 2, 2006 as TWO 2006/021545, the entire disclosure of which is incorporated herein by reference. Priority is claimed based on Federal Republic of Germany patent application no. DE 10 2004 040 656.1, filed Aug. 20, 2004.

BACKGROUND OF THE INVENTION

The present invention relates to a cylinder head cover for a cylinder head of an internal combustion engine.

Known cylinder head covers are placed on the cylinder head of an internal combustion engine and are secured to the cylinder head by attachment bolts. The attachment bolts are usually guided through attachment lugs formed on the cylinder head cover and are screwed together with the underlying cylinder head to secure the cover. To obtain a fluid-tight seal, a circumferential gasket is inserted into the contact region between the cylinder head cover and the cylinder head. This gasket runs through the region of the attachment lugs on the cylinder head cover and is pressed in the attachment direction by the attachment bolts. The tightness between the cylinder head cover and the cylinder head in this prior art solution is ensured by pressing the sealing element in the direction of the attachment force generated by the bolts. The effective direction of the sealing force transmitted by the sealing element matches the effective direction of the attaching force produced by the attachment bolts.

Because the sealing element is pressed in the direction of the attachment force, the resulting restoring forces are high and are transferred from the compressed sealing element to the cylinder head cover and can, particularly at elevated temperatures, lead to a relaxation of the cylinder head cover, which is typically formed of synthetic resin material (i.e., plastic). To prevent such a relaxation, which could lead to leakage, the pressing force of the cylinder head cover on the cylinder head must be reduced. This involves the risk, however, that seal tightness will also decrease.

Increasing the number of attachment bolts can reduce this relaxation since this achieves an approximately uniform surface pressure. The rigidity of the cylinder head cover can furthermore be improved with additional ribs. Both of these measures, however, add weight to the cylinder head cover and are associated with additional costs.

Also to be taken into account is the fact that because of the different linear expansion coefficients of the cylinder head cover, which is formed of synthetic resin material, and the cylinder head, which is usually made of aluminum, the gasket is also subject to pushing and shearing forces, which further stress the gasket.

SUMMARY OF THE INVENTION

It is an object of the present invention to provide an improved cylinder head cover for the cylinder head of an internal combustion engine.

Another object of the invention is to provide a cylinder head cover which can be secured to a cylinder head in a simple manner while reliably assuring adequate sealing between the cover and the cylinder head over a long period of operation.

These and other objects are achieved in accordance with the present invention by providing a cylinder head cover for a cylinder head of an internal combustion engine, said cover having at least one connecting element for securing the cylinder head cover to the cylinder head and a sealing element disposed between the cylinder head cover and the cylinder head, in which the at least one connecting element is associated with a connecting region of the cylinder head cover, and the sealing element is associated with a sealing region of the cylinder head cover; the connecting region and the sealing region are formed independently of each other and are spatially separated, and the force vector of an attachment force transmitted by the at least one connecting element and the force vector of a sealing force transmitted by the sealing element form an angle with each other.

Advantageous preferred embodiments are described in more detail hereinafter.

In the technical solution according to the invention, the connecting element used to hold the cylinder head cover to the cylinder head is disposed in a connecting region on the cylinder head cover, whereas the sealing element is relegated to a sealing region on the cylinder head cover. The connecting region and the sealing region are formed independently of each other and are spatially separated, so that the connecting element—e.g., a connecting bolt or a snap-in hook—does not come into direct contact with the sealing element and, in particular, does not apply a direct pressing force to the sealing element. A surface pressure acting on the sealing element in the attachment direction is produced so that the sealing element is not exposed to increased point loading.

It is further provided that the force vectors of the attachment force transmitted by the connecting element and the sealing force transmitted by the sealing element form an angle, i.e., they intersect or cross. The attachment force of the connecting element typically extends in a vertical direction because the cylinder head cover is placed onto the cylinder head from the top and is attached thereto with bolts or other connecting elements. The sealing force transmitted by the sealing element forms an angle with this vertical attachment force and, in particular, is at least approximately perpendicular to the attachment force, so that a lateral, particularly a radial sealing force component arises. As a result of this configuration with a laterally acting seal, the restoring forces acting on the cylinder head cover in the region of the connecting elements are substantially reduced. The connecting elements only have to perform a mounting function. No high pressing force needs to be generated between the cylinder head cover and the cylinder head, since the sealing action is produced in a plane approximately parallel to the top of the cylinder head and is therefore essentially independent of the attachment force.

This has the result, on the one hand, that the sealing element is subject only to minor stress in vertical direction, i.e., in the direction of the attachment force. On the other hand, because of the low magnitude of the attachment force, only a few connecting elements are required, and the connecting elements can furthermore be of a simple design, e.g., clips or snap-in hooks injection molded onto the cylinder head cover.

The sealing element can be configured in such a way that it is capable, in addition to the connecting elements, of transmitting a clamping force that acts in the direction of the attachment force of the connecting elements which hold the cylinder head cover to the cylinder head. This can be realized, for example, by the sealing element having one or more locking projections on its lateral surface, which are inserted into recesses in the cylinder head cover or the cylinder head and which function as barbs. Due to this capability of transmitting a clamping force running approximately perpendicular to the sealing force, the sealing element makes it possible to minimize the number of connecting elements or reduce them to a particularly simple design with a mounting function. This can be realized, for example, by a simple form-fit connection between the cylinder head cover and the cylinder head.

A support member may be incorporated in the sealing element, with the support member being at least partially or possibly even fully enclosed by the sealing element. This support member can be firmly connected to either the cylinder head or the cylinder head cover or, according to another embodiment, form a support core that is a component of the sealing element and is not connected to the cylinder head or the cylinder head cover. The support core stabilizes the sealing element so as to prevent the sealing element from yielding laterally, particularly during mounting of the cylinder head cover to the cylinder head.

The sealing element can in principle be pre-mounted in either the cylinder head cover or the cylinder head. Both in the cylinder head cover and in the cylinder head the respective connecting region and the sealing region are formed separately to obtain the above described independence of the attachment force and the sealing force.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF PREFERRED EMBODIMENTS

Figure 1:
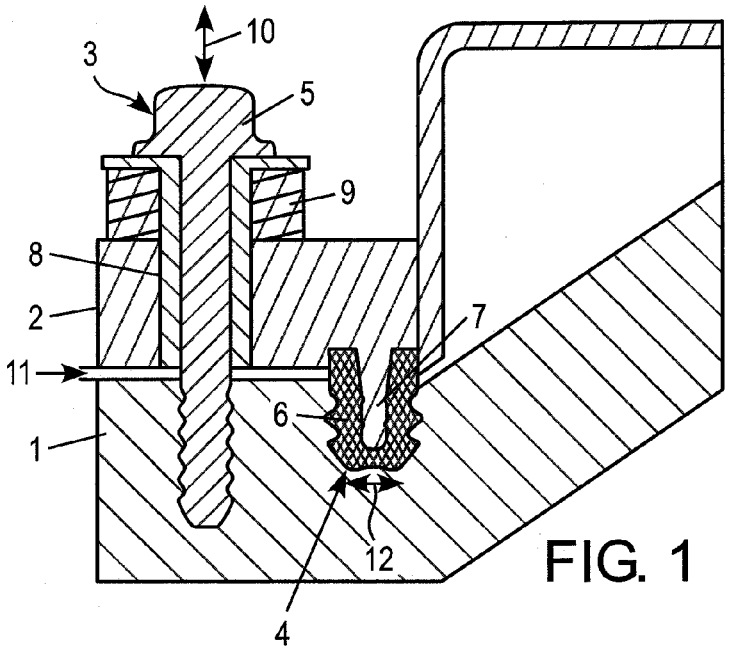
FIG. 1 is a sectional view of a cylinder head cover fixed to a cylinder head taken in the connecting region, showing a connecting element configured as an attachment bolt and independent and spatially separate therefrom a sealing element between the two components.

In the figures, like components are identified by the same reference numerals.

FIG. 1 shows a cylinder head 1 of an internal combustion engine with mounted cylinder head cover 2, which is held to the cylinder head 1 in an outer connecting region 3. Separate therefrom and offset inwardly is a sealing region 4 between the cylinder head 1 and the cylinder head cover 2, which comprises a circumferential sealing element 6 that is inserted into a peripheral groove formed in the top of the cylinder head. The cross-section of sealing element 6 is cup-shaped, and a support member 7 formed integrally with the cylinder head cover 2 projects into the interior of the sealing element 6. The sealing element 6 is slipped onto the support member 7 to obtain a pre-assembled unit. The sealing element 6 extends all around adjacent the outer margin of the cylinder head cover, providing a circumferential seal between the cylinder head and the cylinder head cover.

The connection between the cylinder head cover 2 and the cylinder head 1 includes a connecting element 5 configured as an attachment bolt, which is guided through an opening in the outlying segment of the cylinder head cover. A stabilizing sleeve 8 is inserted into this opening. In addition, a sealing ring 9 receiving an axial force when the connecting element is secured may be placed around the bolt shank of the connecting element 5. The attachment force applied by the connecting element 5 acts in the axial direction as indicated by the double arrow 10 and securely holds the cylinder head cover 2 to the cylinder head 1. To enable axial play and provide vibration decoupling between the cylinder head cover and the cylinder head, a gap 11 is formed in the connecting region 3 between the adjacent surfaces of the cylinder head 1 and the cylinder head cover 2.

This gap 11 is bridged by the sealing element 6 to create a secure and fluid-tight axial connection between the cylinder head 1 and the cylinder head cover 2. The sealing element 6 applies an additional fixing or clamping force between the cylinder head and the cylinder head cover, which acts parallel to the connecting force of the connecting element 5. The sealing force generated by the sealing element 6 extends radially as indicated by double arrow 12 and thus perpendicularly to the attachment force indicated by arrow 10. This provides an effective decoupling between the sealing element 6 and the connecting element 5.

Figure 2:
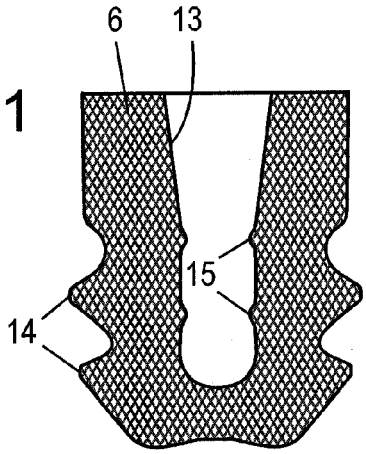
FIG. 2 is an enlarged detail view of the sealing element of the invention.

FIG. 2 shows an enlarged detail of the sealing element 6. The cross-section of the sealing element 6 is cup-shaped and has a central recess 13, into which the support member formed on the cylinder head 7 (FIG. 1) protrudes in the secured state. On the outer lateral surface, the sealing element 6 has a plurality of circumferential locking rings 14, which in cross section taper radially outwardly and improve the clamping within the groove in the cylinder head 1, into which the sealing element 6 is inserted in the mounted state. Locking projections or locking rings 15 may also be provided on the inside of the central recess 13 to firmly clamp the inserted support member.

Figure 3:
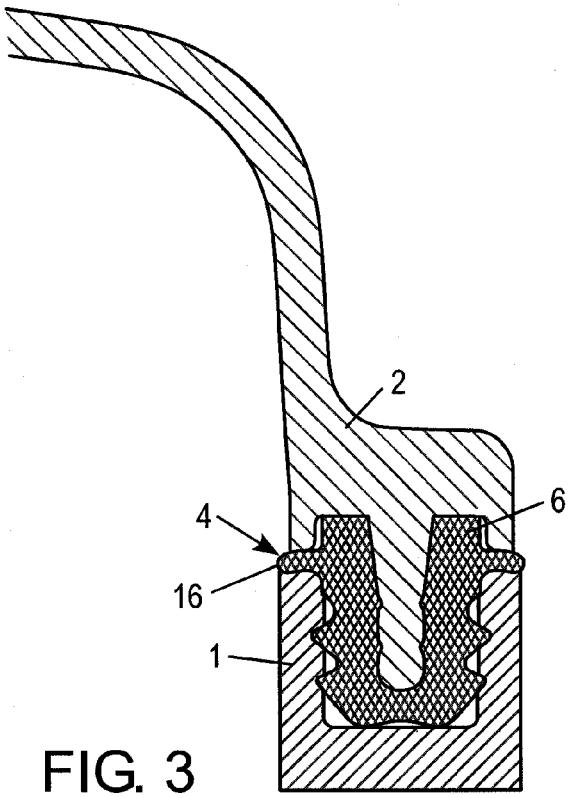
FIG. 3 is a sectional view of the sealing region between the cylinder head cover and the cylinder head of another embodiment of the invention.
Figure 4:
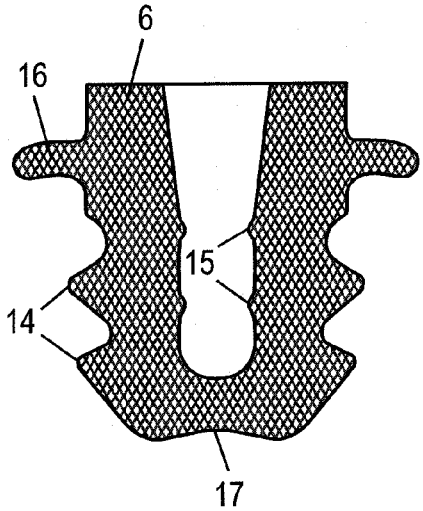
FIG. 4 is an enlarged detail view of the sealing element of FIG. 3.

FIGS. 3 and 4 illustrate a modified embodiment. Adjacent its end face opposite the outside bottom 17, the sealing element 6 has an annular circumferential separating lip 16 protruding radially outwardly into the gap between the cylinder head 1 and the cylinder head cover 2. This separating lip 16 is made of a sealing material and provides effective vibration decoupling between the cylinder head and the cylinder head cover.

Figure 5:
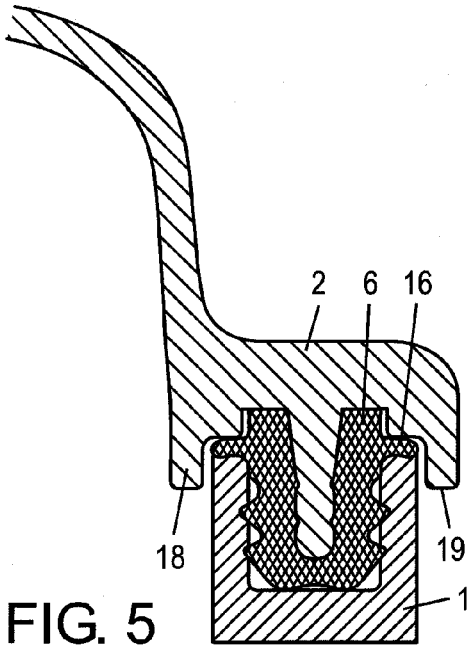
FIG. 5 is a sectional view of the sealing region of a modified cylinder head cover configuration.

The embodiment shown in FIG. 5 essentially corresponds to that depicted in FIGS. 3 and 4 but with the difference that, in the region of the cylinder head cover 2, axially protruding segments 18 and 19 are formed, which axially overlap the sealing element 6 on opposite sides to some extent to bridge the gap between the cylinder head 1 and the cylinder head cover 2.

Figure 6:
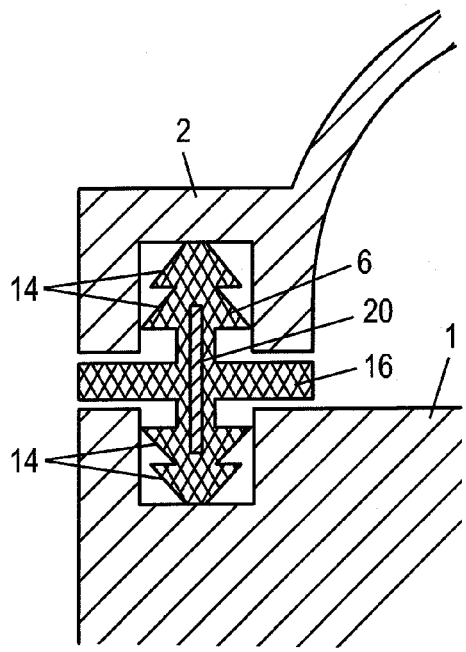
FIG. 6 is a view of another modified sealing region configuration.

In the embodiment depicted in FIG. 6, the sealing element 6 protrudes into opposed groove-shaped recesses formed in the cylinder head cover 2 and in the cylinder head 1. The sealing element 6 is mirror symmetrical relative to a center plane and has a fixed support core 20, which is completely enclosed by the material of the sealing element and stabilizes the sealing element. In the center section, the sealing element 6 has the radially outwardly extending separating lip 16, which in this embodiment is disk-shaped. The axial end segments of the sealing element 6 have a pronounced rib-like structure with locking rings 14 that impart a pine tree type cross-section to the sealing element. These locking rings 14 improve the axial clamping force applied by the sealing element 6 to both the cylinder head 1 and the cylinder head cover 2.

Figure 7:
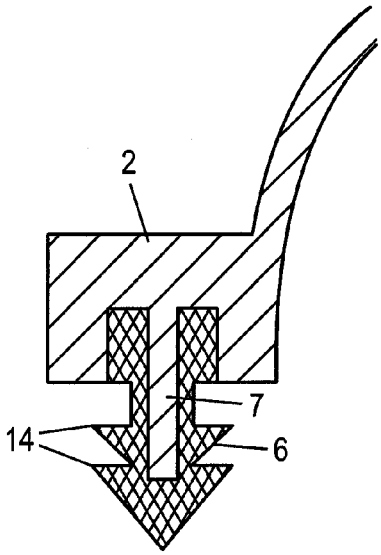
FIG. 7 is a view of the sealing element on the cylinder head cover of yet another modified embodiment of the invention.

In the embodiment illustrated in FIG. 7, the sealing element 6 has a central recess on the cylinder head cover 2 in which a support member 7 is disposed which protrudes vertically downwardly. The outer lateral surface of the sealing element 6 also has the pine tree like ribbing with locking rings 14, which are inserted into a recess in the cylinder head. In contrast to the preceding embodiment, however, the sealing element of FIG. 7 is not mirror symmetrical relative to a transverse center plane. Rather, the segment of the sealing element adjacent the cylinder head cover 2 is formed with straight lateral faces.

Figure 8:
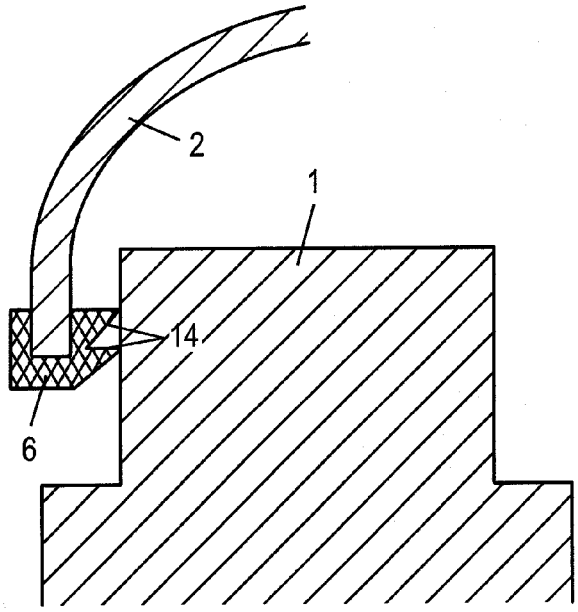
FIG. 8 is an illustration of the cylinder head and cylinder head cover, including the sealing element, of yet another embodiment of the invention.

According to FIG. 8, the sealing element 6 has protruding locking elements 14 only on one side. These elements taper radially outwardly and press against a vertical sidewall of the cylinder head 1.

Figure 9:
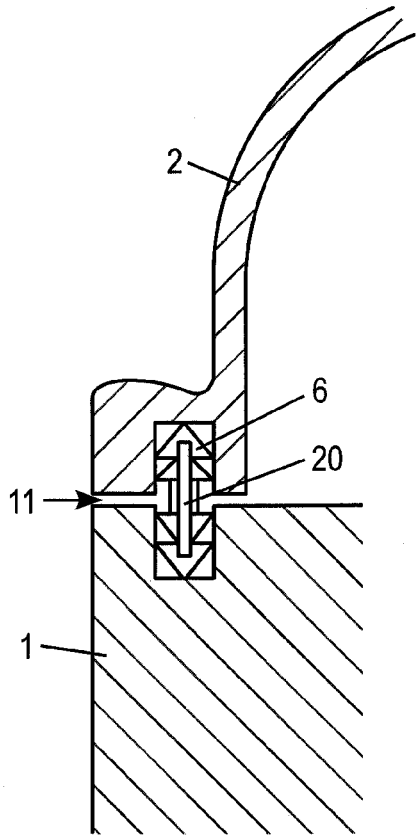
FIG. 9 is a view of the sealing region of yet another modified embodiment of the invention.

The embodiment illustrated in FIG. 9 essentially corresponds to that shown in FIG. 6, but with the difference that the sealing element 6 depicted in FIG. 9 has no central disk-shaped separating lip, so that the gap 11 between the mutually facing sides of the cylinder head 1 and the cylinder head cover 2 is consequently not filled with the sealing material of the sealing element. The decoupling between the cylinder head and the cylinder head cover is obtained by keeping these two components spaced apart via the interposed sealing element 6, such that the sealing element 6 lies in the groove-shaped recesses of both the cylinder head 1 and the cylinder head cover 2.

Figure 10:
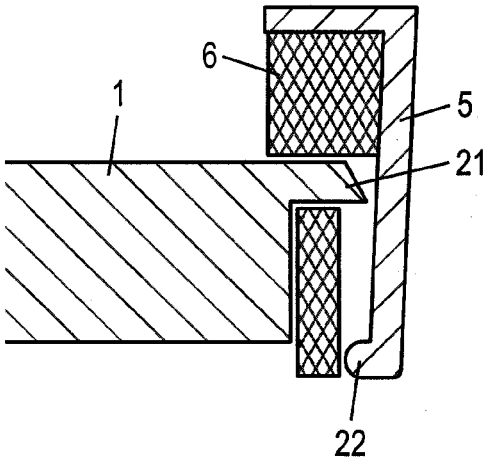
FIG. 10 depicts yet another embodiment of the invention with a connecting element between the cylinder head cover and the cylinder head and a sealing element.
Figure 11:
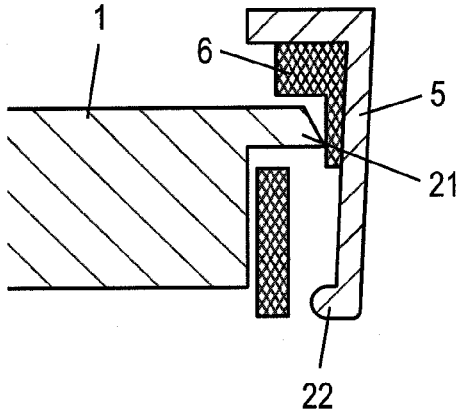
FIG. 11 depicts a modification of the embodiment shown in FIG. 10.

In the embodiments illustrated in FIGS. 10 and 11, the connection between the cylinder head 1 and the cylinder head cover 2 is produced by a connecting element 5 configured as a clip member that is integrally formed with the cylinder head cover or injection molded thereto. On the cylinder head 1, in the connecting region, a radially outwardly protruding shoulder 21 is formed, which forms an undercut relative to a locking projection 22 on the connecting element 5, via which the cylinder head cover is held in captive relation to the cylinder head 1 in a form-fit connection.

In the embodiment depicted in FIG. 11, the sealing element 6 extends up to the outer end face of the shoulder 21. This has the advantage that this end face of the shoulder 21 cannot come into direct contact with the connecting element 5 on the cylinder head cover. This ensures effective vibration decoupling between the cylinder head and the cylinder head cover.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A cylinder head cover for a cylinder head of an internal combustion engine, said cover having at least one connecting element for securing the cylinder head cover to the cylinder head and a sealing element disposed between the cylinder head cover and the cylinder head, wherein:

the sealing element includes a circumferential annular separating lip that extends into the gap between the cylinder head and the cylinder head cover, the separating lip is integrallv formed with a sealing body of the sealing element and is composed of a sealing material which achieves an effective decoupling of vibrations between the cylinder head and the cylinder head cover, the at least one connecting element is associated with a connecting region of the cylinder head cover and the sealing element is associated with a sealing region of the cylinder head cover;

the connecting region and the sealing region are formed independently of each other and are spatially separated, and the force vector of an attachment force transmitted by the at least one connecting element and the force vector of a sealing force transmitted by the sealing element form an angle with each other.

2. A cylinder head cover according to claim 1, wherein the sealing element additionally transmits a clamping force which is parallel to the attachment force transmitted by the at least one connecting element.

3. A cylinder head cover according to claim 1, wherein the sealing element is mounted on one of the cylinder head and the cylinder head cover and protrudes into a recess on the other of the cylinder head and the cylinder head cover.

4. A cylinder head cover according to claim 1, wherein the sealing element has at least one locking projection on a lateral surface thereof.

5. A cylinder head cover according to claim 4, wherein the locking projection is configured as a circumferential locking ring.

6. A cylinder head cover according to claim 5, wherein a plurality of axially spaced circumferential locking rings are provided on the lateral surface of the sealing element.

7. A cylinder head cover according to claim 1, wherein the sealing element at least partially encloses a support member.

8. A cylinder head cover according to claim 7, wherein the support member is secured to the cylinder head.

9. A cylinder head cover according to claim 7, wherein the support member is secured to the cylinder head cover.

10. A cylinder head cover according to claim 7, wherein the support member is constructed as a support core configured independently of the cylinder head and the cylinder head cover.

11. A cylinder head cover according to claim 1, wherein the sealing element has a cup-shaped cross-section.

* * * * *